US005161616A

United States Patent [19]

Colla

[11] Patent Number: 5,161,616

[45] Date of Patent: Nov. 10, 1992

[54] DIFFERENTIAL FIRING HEAD AND METHOD OF OPERATION THEREOF

[75] Inventor: Antonio M. Colla, Anzoategui, Venezuela

[73] Assignee: Dresser Industries, Inc., Dallas, Tex.

[21] Appl. No.: 703,631

[22] Filed: May 22, 1991

[51] Int. Cl.[5] ..... E21B 43/1185

[52] U.S. Cl. ..... 166/297; 166/63; 175/4.56

[58] Field of Search ..... 166/55, 63, 297, 299; 175/4.56, 4.54

[56] References Cited

U.S. PATENT DOCUMENTS

| | | | |
|---|---|---|---|
| 4,369,654 | 1/1983 | Hallmark | 73/151 |
| 4,632,034 | 12/1986 | Colle, Jr. | 166/63 X |
| 4,655,298 | 4/1987 | George et al. | 166/63 X |
| 4,862,964 | 9/1989 | George et al. | 166/297 |
| 4,911,251 | 3/1990 | George et al. | 175/4.56 X |
| 5,062,485 | 11/1991 | Wesson et al. | 166/63 X |

OTHER PUBLICATIONS

Schlumber brochure, "Differential Pressure Firing Head (DPF) for Tubing Conveyed Perforating", 1987.

*Primary Examiner*—David J. Bagnell

[57] ABSTRACT

A differential firing head for a tubing conveyed perforation assembly includes a pressure-balanced firing pin propelled by a separate actuator assembly into a detonator to ignite charges in the gun. The actuator assembly includes a shock absorber which functions to keep fluid pressure momentum forces from being transmitted to the firing pin during movement of the tubing string, but which allows differential fluid pressure forces of a preselected magnitude to be applied to the firing pin for detonation of the gun.

17 Claims, 4 Drawing Sheets

DIFFERENTIAL FIRING HEAD AND METHOD OF OPERATION THEREOF

BACKGROUND OF THE INVENTION

TECHNICAL FIELD

This invention relates generally to the perforation of a well bore utilizing tubing conveyed perforating equipment and specifically relates to a firing head for a perforating gun which utilizes differential pressure to detonate charges in the gun.

BACKGROUND INFORMATION

For perforation of a well casing in a typical tubing conveyed perforating job, a perforating gun is carried on the lower end of a tubing string and lowered into a casing in a well to a position adjacent a formation to be produced. Charges in the gun are discharged by actuation of a firing head attached to the gun thereby forming holes in the casing through which fluid from the formation can flow into the well.

Various ways of actuating the firing head are possible. One way is to use fluid pressure to drive a firing pin in the head into a detonator. Explosion of the detonator in turn ignites a cord leading to all of the charges in the gun. In the differential firing head disclosed in U.S. Pat. No. 4,862,964, tubing pressure and bottom hole pressure act across a piston. When a preselected difference between the pressure of fluid in the tubing string and the pressure of the well fluid surrounding the firing head is reached, a shear pin supporting the piston yields, causing the piston to move so that an initiator rod is impacted against an initiator to discharge a perforating gun.

In another prior arrangement, a piston in the firing head is exposed to the differential of the pressure existing in the annulus above the packer and the tubing pressure. When a preselected pressure differential exists, a shear pin otherwise supporting the piston yields, causing the piston to shift and release a firing pin. One end of the firing pin is exposed to tubing pressure and the other to an assembly pressure (i.e. atmospheric pressure) so that the tubing pressure propels the firing pin to impact against a detonator and discharge the gun. As a safety feature in this prior arrangement in the event the gun misfires, a safety spring acts to shift the firing pin in a direction against the tubing pressure and off the detonator as the firing head reaches the surface during retrieval of the tubing string. Thus, it is possible to more safely remove the firing head from the gun after a misfire.

Also, important to performing a successful perforating job is that differential firing heads of the foregoing general type be kept from inadvertently discharging the gun outside of the intended perforation zone. Problems have been encountered in the past where a firing head discharges prematurely or after a misfire during movement of the tubing string within the well and the well casing is perforated at a location other than at the zone to be produced.

SUMMARY OF THE INVENTION

The present invention contemplates the provision of a unique hydraulic differential firing head which serves to avoid inadvertent discharge of the gun that otherwise may be caused by fluid pressure generated forces created when moving and suddenly stopping the tubing string in the well. More specifically, the present invention aims to accomplish the foregoing by incorporating a novel actuator assembly in the firing head which assembly may be energized by a preselected pressure differential to discharge the gun when the packer is set, but which is pressure-balanced when the packer is released to keep fluid pressure momentum forces from being directed against the firing pin when movement of the tubing string is stopped.

Invention also resides in the use of a unique safing spring to support parts of the actuator assembly away from the firing pin during movement of the string in the well, but particularly after the pin has been struck in an attempt to discharge the perforating gun. Further, invention resides in provision of ports in the firing head and passages so the firing pin is pressure-balanced and effectively hydraulically isolated from the actuator assembly so that pressure generated forces or fluid momentum forces of short duration that travel through the actuator assembly are cushioned from actuating impact against the firing pin to avoid inadvertent discharge of the gun.

Another important advantage of the present invention, is the provision in the tubing string of a shock absorber which uniquely functions when the packer is set to permit the passage of a preselected fluid pressure force for discharging the gun in a normal firing sequence, but functions when the packer is released to keep high fluid pressure generated forces from being transmitted to the firing pin.

Invention also resides in the novel configuration of the actuator assembly to include energizer and hammer pistons with a pressure transmitting fluid disposed therebetween and in the utilization in such fluid of a compressible component for absorbing pressure forces of short duration so as to keep such forces from driving the hammer piston against the firing pin and discharging the gun.

The foregoing and other advantages of the present invention will become more apparent from the following description of the preferred embodiment when taken in conjunction with the accompanying drawings.

BEST MODE FOR CARRYING OUT THE INVENTION

Figure 1:
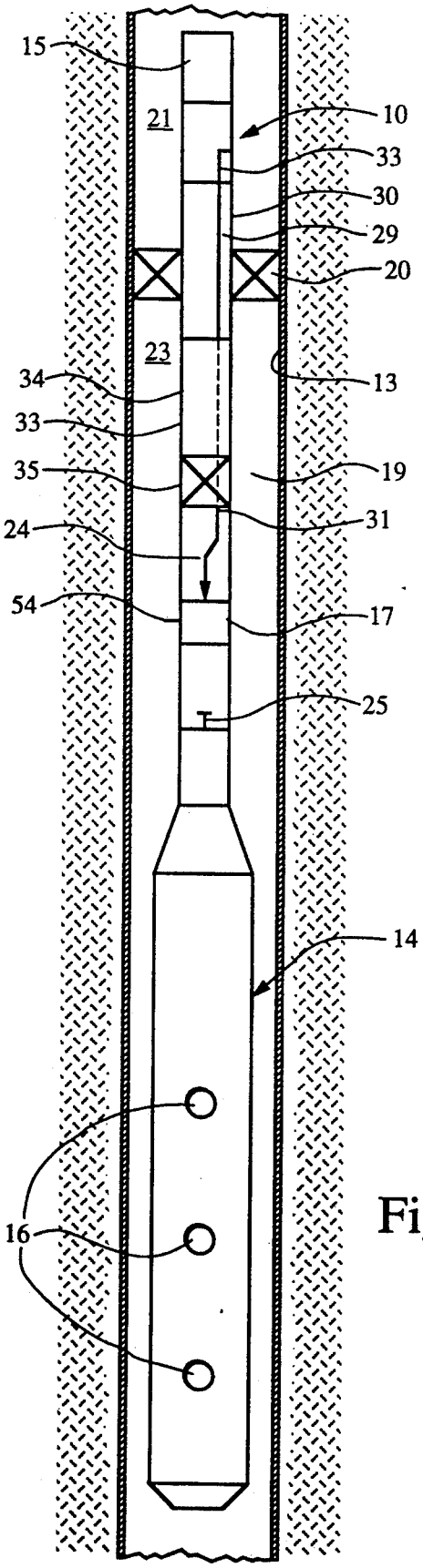
FIG. 1 is a schematic elevational view of a tubing conveyed perforating assembly embodying the novel features of the present invention as installed in a well.

As shown in the drawings for purposes of illustration, the present invention is embodied in a tubing string assembly 10 particularly adapted for use in a well 11 for perforation of a well casing 13 adjacent a formation to be produced. For forming the holes to perforate the casing, a perforating gun 14 is carried on the lower end of tubing 15 which forms the tubing string. In a perforation operation, a gun is lowered in the well on the tubing and is located in the desired vertical position in the well. Charges 16 in the gun are fired to penetrate through the casing forming the holes through which the formation fluid can flow into the well. In the present instance, a firing head 17 is connected in the tubing string between the lower end of the tubing and the perforating gun and is discharged through the use of a hydraulic pressure to ignite the charges. The pressure for discharging the firing head is provided by a hydraulic pressure differential developed between the well fluid pressure existing in the annulus 19 outside of the tubing and the inside tubing pressure.

Specifically, a packer 20 (see FIG. 1) in the tubing string 10 is set in the well dividing the annulus 19 into upper and lower portions 21 and 23, respectively, which are sealed from each other by the packer. A differential pressure may be created between the fluid in the annulus 19 by pressurizing the upper annulus 21 from the well head. Generally speaking, pressurization of the upper annulus to create the desired pressure differential may be accomplished by pumping fluid into the upper annulus, removing fluid from the tubing or a combination of both actions. This pressure differential is used for energizing an actuator assembly 24 in the firing head 17. When the pressure differential exceeds a preselected magnitude, the actuator assembly drives a firing pin 25 (see FIG. 2) mounted in the head into a detonator 26 discharging the detonator. This in turn ignites a primer cord 27 leading to the charges 16 in the gun thereby firing all the charges to perforate the casing 13.

As shown in FIG. 1, pressure fluid sourced from the upper annulus 21 is supplied to the firing head 17 through a passage 29 leading from an upper port 30 formed through the tubing to an inlet 31 in the firing head. Herein, the passage 29 is defined by the annular space between a transfer tube 33 (shown schematically in FIG. 1) in the inside of the well tubing 15. Connected to the upper end of the transfer tube is a crossover sub (not detailed) which contains the upper port 30 for fluid to flow from the upper annulus 2 into the passage 29. The transfer tube extends through the well tubing from above the packer 20 to a position below the packer and connects with a flow sub 33. The flow sub includes a lower flow port 34 connecting the inside of the tubing 15 with the lower annulus 23 of the well. A tubing plug 35 (shown schematically in FIG. 1) blocks the flow of fluid in the tubing toward the firing head 17.

Figure 2:
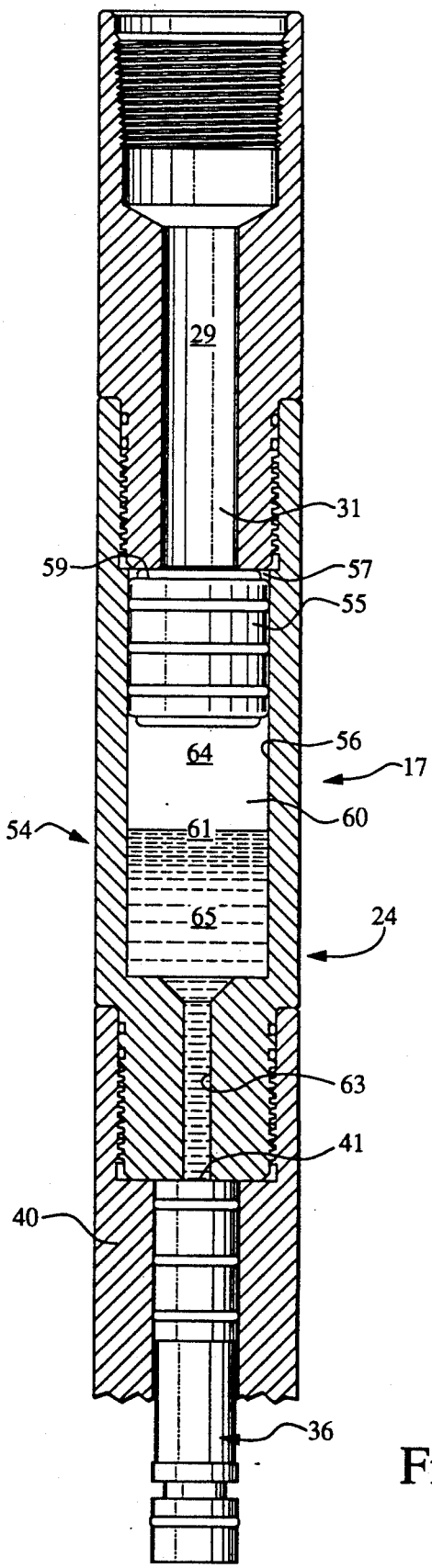
FIG. 2 is an enlarged cross-sectional view of the differential firing head shown in the assembly of FIG. 1 with parts of the firing head shown prior to detonation of the perforating gun.
Figure 2:
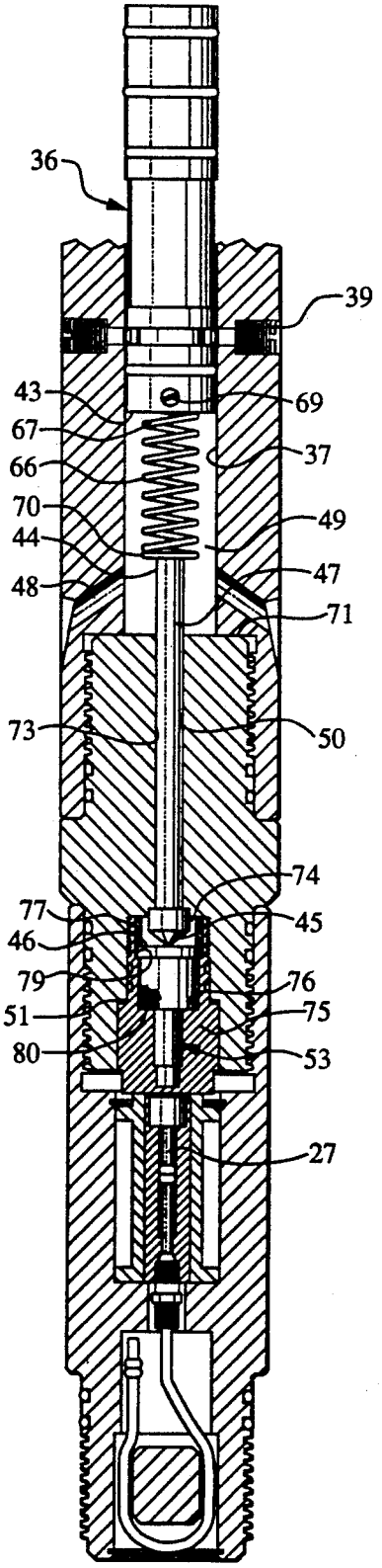
Figure 3:
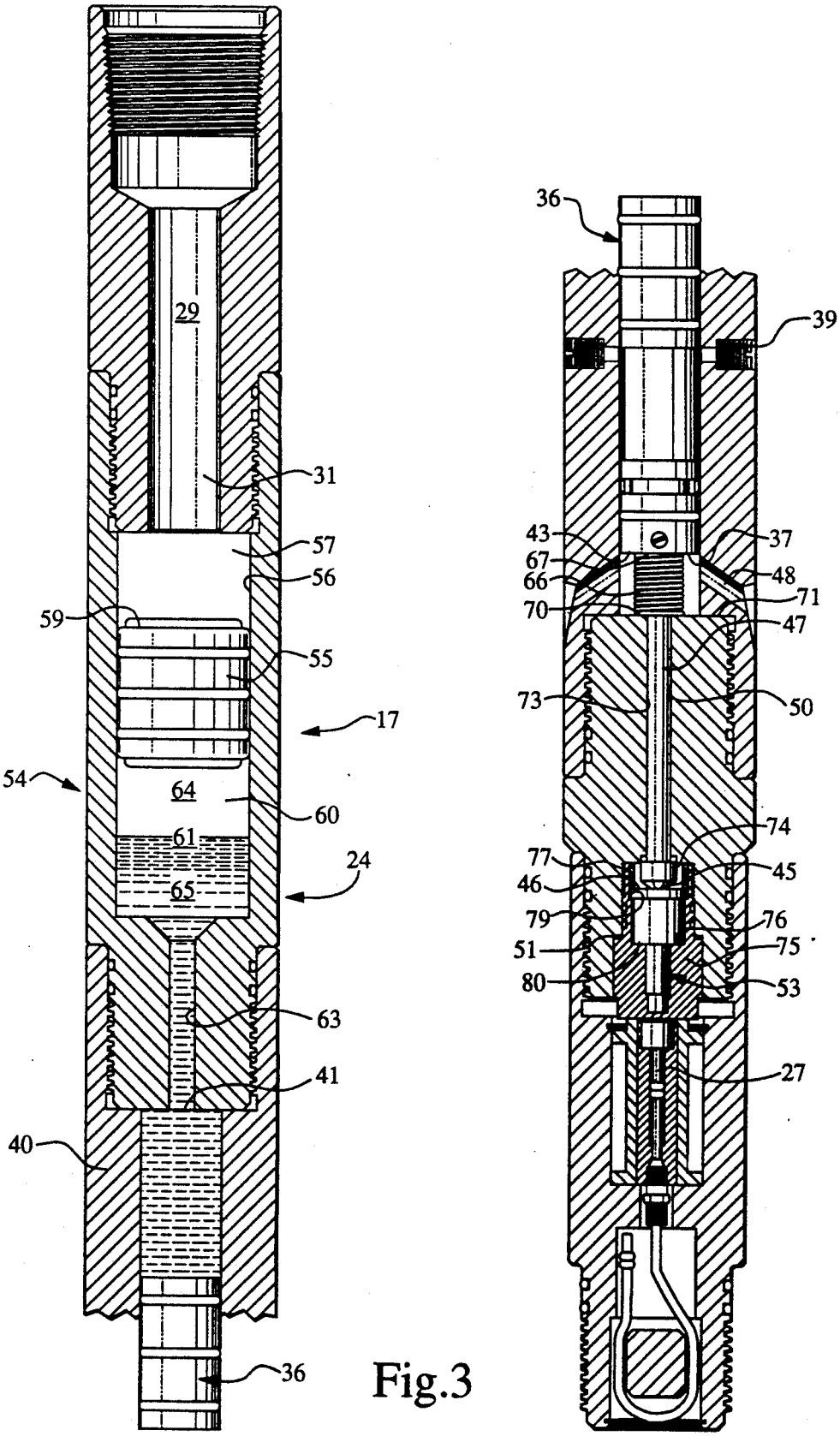
FIG. 3 is a cross-sectional view similar to FIG. 2 but showing parts of the differential firing head in moved positions and impacting the detonator.

Within the firing head 17, the differential pressure force between the upper annulus well pressure and the tubing pressure or ambient lower annulus well pressure which exists adjacent to firing head is utilized to propel an actuating hammer 36 against the firing pin 25. As shown in FIGS. 2 and 3, when the upper annulus 21 is pressurized to the aforementioned preselected pressure differential, an actuating force is transferred through the actuator assembly 24 driving the hammer 36 to strike the firing pin 25 to ignite the detonator 26. Herein, the portion of the actuator assembly comprising the hammer 36 is a piston mounted within a hammer piston cylinder 37. Prior to actuation of the firing head, the hammer piston 36 is supported in a set position (see FIG. 2) by shear screws 39 anchored within a tubular body 40 of the firing head. Fluid pressure in the lower annulus 23 or bottom hole fluid pressure is communicated with a lower face 43 of the hammer piston by way of a lower well port 48. The latter is formed through the body of the firing head exiting into a lower chamber 49 of the hammer piston cylinder 37. From this it will be readily understood that with the upper face of the hammer piston subjected to the pressure generated in the upper annulus and the lower face of the piston exposed to the bottom hole pressure, a selected pressure differential may be created across the hammer piston for firing the gun. When this pressure generated force exceeds the combined shear strength of the screws 39, the screws shear and the piston is propelled downward with the lower face 43 of the piston impacting an upper end 44 of the firing pin 25. The firing pin is thus driven downwardly and with a pointed lower end 45 of the firing pin resting against an upper face 46 of the detonator that causes the detonator to ignite.

More specifically, the firing pin 25 is supported within the lower end portion of the body 40 of the firing head 17 with an upper end portion 47 of the firing pin extending into the lower chamber 49 of the hammer piston cylinder 37 from a central guide bore 50. Protruding from the other end of the guide bore is the pointed lower end portion 45 of the firing pin, extending into a primer assembly chamber 51. The latter chamber contains a primer assembly 53 including the detonator 26 and the firing cord 27. In the initial assembly or set position for the firing pin 25, the pointed lower end 45 rests upon the upper face 46 of the detonator so that when the upper end 44 of the firing pin is struck by the hammer 36, the lower end embeds in the detonator discharging the detonator to ignite the firing cord and the explosive charges in turn to form holes through the casing 13.

It is, of course, important to the perforation of the casing 13 that the holes be formed in the intended perforation zone adjacent the formation to be produced. Holes formed in the casing during movement of the tubing string because of premature detonation of the perforating guns or inadvertent detonation of the guns subsequent to a misfire are highly undesirable.

In accordance with the broadest aspect of the present invention, a shock absorber 54 is uniquely incorporated in the tubing string 10 above the firing pin 25 and serves to keep fluid pressure momentum forces which are generated during movement of the tubing string in the well 11 from energizing the actuator assembly 24 and discharging the perforating gun 14. For this purpose, the shock absorber is constructed so as to be substantially inactivated when the packer 20 is set but activated when the packer is released. Specifically, this is accomplished by subjecting the shock absorber to the differential pressure forces existing between the upper and lower annuluses 21 and 23 when the packer is set and pressure balancing the shock absorber when the packer is released. With the packer set, a substantial portion of its shock absorbing capacity is absorbed during pressurization of the upper annulus. As a result, the shock absorber will transmit fluid pressure forces of sufficient magnitude and duration to energize the actuator assembly. But, when the packer is released, fluid pressure momentum forces that are generated momentarily when stopping the tubing string, for example, are absorbed at least in part enough to keep the firing pin from being driven into the detonator 26 with sufficient force to ignite it.

In the present instance, the shock absorber 54 is included in the actuator assembly 24 and comprises an energizer piston 55 disposed within the body 40 of the firing head 17 above the hammer piston 36. Specifically, the energizer piston is slidably mounted within an energizer piston cylinder 56 including an upper pressure receiving chamber 57. The latter is connected with the inlet 31 of the firing head so that pressure fluid from the upper annulus 21 communicates with an upper face 59 of the energizer piston through the passage 29. Defined within the energizer piston cylinder below the piston 56 is a pressure transmitting chamber 60 containing a pressure transmitting fluid 61. The latter communicates with the hammer piston cylinder 37 through a fluid passage 63. As shown in FIG. 2, the energizer piston cylinder is larger in diameter than the diameter of the hammer piston cylinder, and the diameter of the fluid passage 63 is less than the diameter of the hammer piston chamber. With this arrangement, it will be appreciated that when the perforating gun 14 is properly located in the well 11 and the packer 20 is set, fluid pressure from pressurization of the upper annulus 21 will be transferred through the transfer passage 29 into the pressure receiving chamber 57 forcing the energizer piston 55 downwardly. This in turn pressurizes the pressure transmitting fluid 61 below the energizer piston 55 to flow through the passage 63 into the upper chamber of the hammer piston cylinder 37. Once the pressure force on the upper face of the hammer piston 36 exceeds the combined yield strength of the shear screws 39, the screws break and the hammer piston is propelled downwardly to strike the firing pin 25 igniting the detonator 26.

Advantageously, in order to permit the transfer of sufficient actuating force when the packer 20 is set but not when the packer is released, the pressure transmitting fluid 61 is comprised of relatively compressible and incompressible components 64 and 65. As shown in FIG. 2, the compressible portion of the transmitting fluid 61 is a gaseous component, herein, air at atmospheric pressure which is captured in the pressure transmitting chamber 56 during manufacturing of the firing head 17. The substantially incompressible component is a suitable hydraulic oil 65. During pressurization of the upper annulus 21, the gaseous component 64 of the pressure transmitting fluid 61 is compressed by the energizer piston 55 to the preselected pressure at which the shear screws 39 fail and the perforating gun is discharged. As shown in FIG. 3, the gaseous component of the pressure transmitting fluid remains substantially compressed even after the hammer piston is driven against the firing pin because of the comparatively large volume of upper annulus fluid supplied through the passage 29. Thus, not only is the hammer piston propelled toward the firing pin by the sudden release of the shear screws, but it is also accelerated into the pin by the same differential pressure forces acting on the hammer piston for the full length of travel of the hammer piston.

Figure 4:
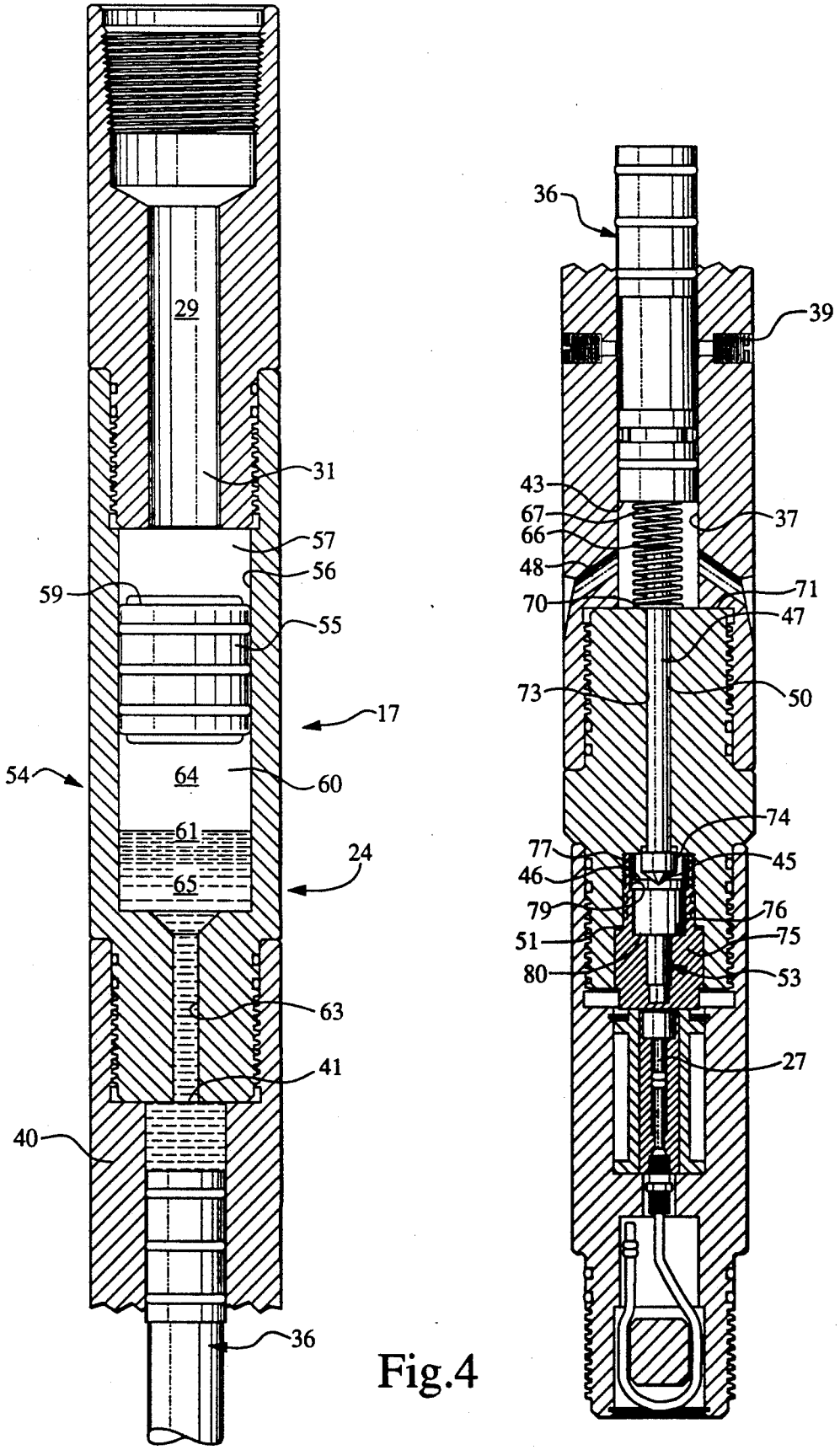
FIG. 4 is a cross-sectional view similar to FIG. 3 but showing parts of the firing head in further moved positions during retrieval of the tubing string carrying the firing head.

However, with pressures in the upper and lower annuluses 21 and 23 equalized such as when moving the tubing string 10 within the well 11, there is no differential pressure seen across the energizer piston cylinder 56. As is illustrated in FIG. 4, under these conditions, the compressible fluid 64 expands equalizing with the ambient fluid pressure existing for the vertical position of the firing head 17 in the well. The compressible fluid thus serves to absorb fluid pressure momentum forces that otherwise may be transferred to the firing pin 25 by the hammer piston 36 as movement of the tubing string 10 through the well is started and stopped. For example, when first lifting the tubing string in the well from a rest position, it will be appreciated that the acceleration of the mass of the fluid column in the passage 29 will create a pressure differential across the actuator assembly 24 of the firing head 17. Intensifying this differential may be a suction drawn on the fluid in the lower annulus 23 due to a swabbing or lifting of fluid in the upper annulus 21 by the packer 20, as well as a lifting of the fluid within the tubing string itself. These and other similar fluid pressure momentum forces which momentarily act across the actuator assembly when suddenly stopping downward movement of the tubing string in the well are dampened by action of the shock absorber 54 to avoid transmitting forces of sufficient magnitude and duration to the firing pin and causing the pin to unintentionally discharge the detonator 26.

Supplementing the action of the compressible fluid 64 in accordance with another important feature of the present invention is a safing spring 66 which is located between the hammer piston 36 and the firing pin 25, and reacts between the hammer piston and the body 40 of the firing head 17 to keep the hammer piston off of the firing pin after the shear screws 39 have been broken. As a result, any fluid pressure momentum forces which act on the hammer piston are additionally absorbed between the body of the firing head and the hammer piston. In the present instance, the safing spring 66 is a coil spring with an upper end 67 secured to the lower face 43 of the hammer piston 36 such as by means of a set screw 69. A lower end 70 of the spring 66 is spaced upwardly of a lower end wall 70 of the lower chamber 49 of the hammer piston cylinder. The open center of the coil of the spring telescopes slightly over the upper end of the firing pin 25 when the hammer piston is in its set position. When the hammer piston 36 is propelled against the firing pin 25 by the fluid pressure entering an upper chamber 41 of the hammer piston cylinder 37, the spring slides over the firing pin, abutting the lower end wall 71 of the lower hammer chamber 49. The spring is compressed between the hammer piston until the lower face 43 of the hammer piston strikes the upper end 44 of the firing pin and drives the pointed lower end 45 of the pin into the detonator 26 as is shown in FIG. 3. When the pressure driving the hammer piston 36 is released or the pressure across the actuator assembly 17 is balanced, the energy stored in the spring 66 returns the hammer piston from its fire position as shown in FIG. 3 upwardly into a safe position as shown in FIG. 4 with the spring compressed slightly by the weight of the hammer piston and friction resistance of the hammer piston seals against the inside wall of the hammer piston cylinder 37. In this position, the lower face 43 of the hammer piston is again spaced from the upper end 44 of the firing pin so that the spring provides a cushion against fluid pressure momentum forces being transmitted through the hammer piston to the firing pin. Similarly, the spring 66 serves to absorb the inertial and momentum forces developed due to the weight of the hammer piston itself as movement of the tubing string is started and stopped.

Another advantageous structural feature of the exemplary firing head 17 is the pressure balancing of the firing pin itself separately of the actuator assembly 24 and with the tubing or downhole pressure ambient to the firing head 17. With this arrangement, the tubing pressure, no matter how high, is incapable of driving the firing pin into the detonator 25 and discharging the perforating gun 14. Herein, the pressure balancing of the firing pin is achieved by providing a leakage fluid path 73 along the pin 25 and within the guide bore 50 through which the pin extends between the hammer piston cylinder 37 and the primer assembly chamber 51. Thus, the ambient well or tubing pressure existing adjacent to the firing pin communicates through the lower well port 48 to the lower hammer piston chamber 49 and therefrom through the leakage path 73 and the bore 59 along the firing pin 25 so that both the upper and lower ends 44 and 45 of the firing pin are pressure balanced by exposure to the same fluid pressure. While an upper end portion 74 of the primer assembly chamber 51 is exposed to well fluid, the fluid is prevented from entering the firing head below the detonator. For this purpose, seals are provided between the detonator 25 and the inside of the primer assembly chamber. As shown more particularly in FIG. 2, the detonator is mounted within a holder 75 threadably secured within the primer assembly chamber 51. The holder includes an upwardly facing recess 76 receiving the detonator 26, a spacer sleeve 77 acting between the upper end of the primer assembly chamber and the upper face 46 of the detonator forces the detonator to seat against the bottom of the recess and an annular shoulder 79. Squeezed between the underside of the detonator 26 and the bottom of the recess 76 is an o-ring seal 80 which keeps fluid from the upper portion 74 of the primer assembly chamber from wetting below the detonator.

In view of the foregoing, it is seen that the present invention brings to the art a new and improved assembly and firing head 17 for using differential pressure to discharge the perforating guns 14. Advantageously, incorporation of the shock absorber 54 in the tubing string 10 above the firing pin 25 keeps the fluid pressure momentum forces generated during movement of the tubing string from causing the guns to be detonated outside of the desired zone to be perforated.

I claim:

1. In a hydraulically actuated differential firing head for use on a tubing string conveyed perforating gun in a well the improvement comprising a shock absorber piston assembly including a compressible fluid for reducing the likelihood for unintended detonation of the gun from fluid pressure generated forces occurring during movement of the tubing string in the well.

2. A firing head connectable to a perforating gun and responsive to an application of fluid pressure from a source to fire explosive charges contained within said gun when a preselected differential pressure is reached from between said source and the ambient pressure of said head, said firing head comprising, a generally tubular body; an energizer piston cylinder within said body; an energizer piston in said energizer piston cylinder and dividing said cylinder into pressure-receiving and pressure-transmitting chambers; an inlet to said pressure-receiving chamber connectable to said pressure source; an outlet to said pressure-transmitting chamber; a fluid filling said pressure-transmitting chamber of said cylinder and supporting said energizer piston within said cylinder, said fluid including a gaseous component and a liquid component; a hammer piston cylinder in said body and including upper and lower hammer chambers; a fluid passage connected between said outlet and said upper hammer chamber; a hammer piston in said hammer piston cylinder for movement between set, fire and safe positions, said hammer piston having upper and lower faces thereon, said upper face being subjected to the fluid pressure within said upper hammer chamber; a shear screw connected between said body and said hammer piston, said screw initially supporting said hammer piston in said set position and releasing said hammer piston for movement into said fire position when said preselected differential pressure is reached; a safing spring mounted within said lower hammer chamber for urging said hammer piston into said safe position after said screw is sheared; a primer assembly chamber contained within said body, said primer assembly chamber having an upper end portion thereof pressure-balanced with respect to said lower hammer chamber; a primer assembly mounted within said primer assembly chamber and including a detonator with a upper face exposed to said upper end portion of said primer assembly chamber, a firing cord connectable between said detonator and the charges within said gun, said cord being sealed from fluid communication with said upper end portion of said primer assembly chamber; and a firing pin mounted within said body and having a lower end engaging said detonator and an upper end protruding into said lower hammer chamber to be struck by said hammer piston after said preselected differential pressure is reached causing said detonator to discharge and ignite the explosive charges in said gun.

3. A hydraulically actuated differential firing head for use within a tubing string in a well between a packer and a tubing conveyed perforating gun, said differential firing head including a tubular body having one end connectable to the tubing string and an opposite end connectable to the gun, a detonator mounted in said opposite end and ignitable when struck to discharge said gun; an actuator assembly within said body between said ends, said actuator assembly being energizable to transmit a fluid pressure generated force of a preselected magnitude and duration for firing said gun, said actuator assembly including a shock absorber to avoid transmitting fluid pressure generated forces of lesser duration to keep from detonating the gun during movement of the tubing string in the well; and a firing pin slidably mounted within said body adjacent said detonator and engageable by said actuator assembly to strike said detonator causing said detonator to ignite.

4. A hydraulically actuated differential firing head for use within a tubing string in a well between a packer and a tubing conveyed perforating gun, said differential firing head including a tubular body having one end connectable to the tubing string and an opposite end connectable to the gun, a detonator mounted in said opposite end and ignitable when struck to discharge said gun; an actuator assembly within said body between said ends, said actuator assembly being energizable to transmit a fluid pressure generated force of a preselected magnitude and duration for firing said gun, said actuator assembly including a shock absorber to avoid transmitting fluid pressure generated forces of lesser duration to keep from detonating the gun during movement of the tubing string in the well; a firing pin slidably mounted within said body adjacent said detonator and engageable by said actuator assembly to strike said detonator causing said detonator to ignite, a safing spring supporting said actuator assembly spaced from said firing pin after striking said firing pin.

5. A differential firing head as defined in claim 4 wherein said actuator assembly includes an energizer piston cylinder within said body; an energizer piston in said energizer piston cylinder; a hammer piston cylinder in said body; a hammer piston in said hammer piston cylinder hydraulically connected to said energizer piston chamber and movable between set, fire and safe positions, said shock absorber being located hydraulically between said energizer and hammer pistons for transmitting said fluid pressure generated force of preselected magnitude and duration from said energizer piston to said hammer piston.

6. A differential firing head as defined in claim 5 wherein said shock absorber includes a pressure-transmitting chamber in said energizer piston cylinder; an outlet to said pressure-transmitting chamber; a passage connected between said pressure-transmitting chamber and said hammer piston cylinder for fluid flow therebetween; fluid filling said pressure-transmitting chamber and supporting said energizer piston within said energizer piston cylinder, said fluid being at least partially compressible to keep fluid pressure forces generated during movement of the tubing string in the well from causing said hammer piston to strike and ignite said detonator.

7. A differential firing head as defined in claim 6 wherein said fluid filling said pressure-transmitting chamber includes a gas portion and an oil portion.

8. A hydraulically actuated differential firing head for use within a tubing string in a well between a packer and a tubing conveyed perforating gun, said differential firing head including a tubular body having one end connectable to the tubing string and an opposite end connectable to the gun, a detonator mounted in said opposite end and ignitable when struck to discharge said gun; an actuator assembly within said body between said ends, said actuator assembly being energizable to transmit a fluid pressure generated force for firing said gun; a pressure-balanced firing pin slidably mounted within said body adjacent said detonator and engageable by said actuator assembly to strike said detonator causing said detonator to ignite; and a safing spring supporting said actuator assembly spaced from said firing pin after striking said firing pin.

9. An assembly for tubing conveyed perforation of a well including a string of tubing for insertion into the well; a perforating gun connected to the tubing in said string; a packer connected in the tubing above said perforating gun; a differential firing head connected in the tubing between said packer and said gun and including an inlet for pressurized actuating fluid; an upper well annulus defined outside of the tubing in said string and above said packer when said packer is set in the well; a lower well annulus defined outside of the tubing in said string and below said packer when said packer is set in the well; and a pressure fluid passage through said tubing for communicating fluid from said upper well annulus to said inlet; said firing head including a tubular body having one end connectable to the tubing string and an opposite end connectable to said gun, a detonator mounted in said opposite end and ignitable when struck to discharge said gun, an actuator assembly within said body between said ends, said actuator assembly being energizable to transmit a fluid pressure generated force of a preselected magnitude for firing said gun when said packer is set, said actuator assembly being pressure-balanced when said packer is released, a pressure-balanced firing pin supported within said body adjacent said detonator to be struck by said actuator assembly to cause said detonator to ignite and fire said gun when said actuator assembly is energized to said preselected magnitude, and a lower well port in said body for communicating fluid pressure in said lower annulus to said firing pin when said packer is set.

10. An assembly as defined by claim 9 including a shock absorber within said tubing string and above said firing pin for transmitting said fluid pressure generated force to said firing pin at said preselected magnitude when said packer is set, said shock absorber also serving during movement of the tubing string in the well to keep fluid pressure forces from acting against said pin to cause said pin to ignite said detonator.

11. An assembly for tubing conveyed perforation of a well including a string of tubing for insertion into the well; a perforating gun connected to the tubing in said string; a packer connected in the tubing above said perforating gun; a differential firing head connected in the tubing between said packer and said gun and including an inlet for pressurized actuating fluid; an upper well annulus defined outside of the tubing in said string and above said packer when said packer is set in the well; a lower well annulus defined outside of the tubing in said string and below said packer when said packer is set in the well; and a pressure fluid passage through said tubing for communicating fluid from said upper well annulus to said inlet; said firing head including a tubular body having one end connectable to the tubing string and an opposite end connectable to said gun, a detonator mounted in said opposite end and ignitable when struck to discharge said gun, an actuator assembly within said body between said ends, said actuator assembly being energizable to transmit a fluid pressure generated force of a preselected magnitude for firing said gun when said packer is set, said actuator assembly being pressure-balanced when said packer is released, a pressure-balanced firing pin supported within said body adjacent said detonator to be struck by said actuator assembly to cause said detonator to ignite and fire said gun when said actuator assembly is energized to said preselected magnitude, a lower well port in said body for communicating fluid pressure in said lower annulus to said firing pin when said packer is set, and a safing spring acting between said body and said actuator assembly and for supporting said actuator assembly away from said firing pin during movement of the tubing string in the well.

12. An assembly is defined by claim 11 including a shock absorber within said tubing string and above said firing pin for transmitting said fluid pressure generated force to said firing pin at said preselected magnitude when is packer is set, said shock absorber also serving during movement of the tubing string in the well to keep fluid pressure forces from acting against said pin to cause said pin to ignite said detonator.

13. A method for operation of a differential firing head to hydraulically propel a hammer to impact a firing pin against a detonator to discharge a perforating gun connected to the firing head comprising the steps of connecting firing head in a tubing string between a packer and the perforating gun with a passage communicating through the tubing between one side of a piston assembly in the firing head and a port located in the string above the packer leading to the well annulus, lowering the string into a well to position the gun adjacent the formation to be perforated, setting the packer to seal an upper portion of the annulus above the packer from a lower portion of the annulus below the packer, pressure-balancing opposite ends of the firing pin at the well pressure of the lower portion of the annulus, pressurizing the upper portion of the annulus of the well and in turn said one side of the piston assembly through said passage to a preselected pressure whereupon a piston in the piston assembly is propelled against the firing pin to impact the pin against the detonator, releasing the packer to equalize the pressures in the upper and lower portions of the annulus, and lifting the impact piston off the firing pin as the pressures in the upper and lower portions of the annulus equalize to avoid discharging of the gun during retrieval in the event of a misfire.

14. A hydraulically actuated differential firing head for use within a tubing string in a well between a packer and a tubing conveyed perforating gun, said differential firing head including a tubular body having a piston actuator assembly therein, said actuator assembly being pressure-balanced when the packer is released and energizable when said packer is set to transmit a pressure differential for firing said gun, a pressure-balanced firing pin in said body and associated with said piston actuator assembly for igniting the gun when struck by said actuator assembly, and a safing spring acting within said body so said firing pin is in a safe position when the piston actuator assembiy is pressure-balanced.

15. A hydraulically actuated differential firing head as defined in claim 14 wherein said safing spring is located between said firing pin and said actuator assembly and said safe position for said firing pin is with said spring supporting and said actuator assembly spaced from said firing pin when the piston actuator assembly is pressure balanced.

16. A hydraulically actuated differential firing head for use within a tubing string in a well between a packer and a tubing conveyed perforating gun, said differential firing head including a tubular body having upper and lower ends, said upper end being connectable within the tubing string, a detonator mounted in said lower end and ignitable when struck to discharge said gun; a piston actuator assembly mounted within said body between said upper and lower ends, said piston actuator assembly being pressure-balanced when the packer is released and energizable when said packer is set to transmit a pressure differential force for firing said gun, said piston actuator assembly including a shock absorber for reducing the likelihood of unintended detonation of the gun from fluid pressure generated forces occurring during movement of the tubing string in the well; a pressure-balanced firing pin slidably mounted within said body adjacent said detonator and engageable by said piston actuator assembly to strike said detonator causing said detonator to ignite; and a safing spring supporting said piston actuator assembly spaced safely away from said firing pin when the piston actuator assembly is pressure-balanced after striking said firing pin.

17. An assembly for tubing conveyed perforation of a well in an intended perforation zone including a string of tubing for insertion into the well; a perforating gun connected to the tubing in said string; a packer connected in the tubing above said perforating gun; a differential firing head connected in the tubing between said packer and said gun and including an inlet for pressurized actuating fluid; an upper well annulus defined outside of the tubing in said string and above said packer; a lower well annulus defined outside of the tubing in said string and below said packer; a pressure fluid passage communicating fluid from said upper well annulus to said inlet; said firing head including a detonator mounted therein and ignitable when struck to discharge said gun, a firing pin supported within said firing head adjacent said detonator, an actuator assembly within said firing head and energizable to transmit a fluid pressure generated force of a preselected magnitude produced by the differential existing between the fluid pressures in said upper and lower annuluses when said packer is set to drive said firing pin into said detonator to cause said detonator to ignite and fire said gun, and a lower well port in said firing head for communicating fluid pressure in said lower annulus to said actuator assembly so that when said packer is released said actuator assembly is pressure-balanced; and a shock absorber in said string above said firing pin serving to avoid transmitting fluid pressure momentum forces through said actuator during movement of the tubing string in the well with sufficient force to drive said firing pin against said detonator so as to ignite said detonator and discharge said gun outside of the intended perforation zone.

* * * * *